United States Patent [19]

Groet

[11] 4,082,553

[45] Apr. 4, 1978

[54] INTERIMAGE EFFECTS WITH SPONTANEOUSLY DEVELOPABLE SILVER HALIDE

[75] Inventor: Nicholas H. Groet, Rochester, N.Y.

[73] Assignee: Eastman Kodak Company, Rochester, N.Y.

[21] Appl. No.: 688,445

[22] Filed: May 20, 1976

Related U.S. Application Data

[63] Continuation-in-part of Ser. No. 566,648, Apr. 10, 1975, abandoned.

[51] Int. Cl.[2] ..... G03C 1/76; G03C 3/00; G03C 7/00; G03C 7/16

[52] U.S. Cl. ..... 96/74; 96/22; 96/55; 96/69

[58] Field of Search ..... 96/16, 22, 55, 68, 69, 96/72, 73, 74, 77, 8, 9, 21

[56] References Cited

U.S. PATENT DOCUMENTS

| | | | |
|---|---|---|---|
| 2,253,070 | 8/1941 | Evans | 96/7 |
| 2,319,369 | 5/1943 | Sease et al. | 96/22 |
| 2,875,052 | 2/1959 | Weyde | 96/74 |
| 2,937,086 | 5/1960 | Yutzy et al. | 96/74 |
| 2,996,382 | 8/1961 | Luckey et al. | 96/68 |
| 3,227,551 | 1/1966 | Barr et al. | 96/3 |
| 3,536,487 | 10/1970 | Graham | 96/22 |
| 3,607,278 | 9/1971 | Ditzer et al. | 96/68 |
| 3,630,745 | 12/1971 | Beavers et al. | 96/66.5 |
| 3,737, 317 | 6/1973 | Nicholas et al. | 96/74 |
| 3,832,174 | 8/1974 | Bello et al. | 96/74 |

OTHER PUBLICATIONS

Mees et al., *The Theory of the Photographic Process,* The Macmillan Co., New York, © 1966, pp. 342, 343.

*Primary Examiner*—David Klein
*Assistant Examiner*—Richard L. Schilling
*Attorney, Agent, or Firm*—Carl O. Thomas

[57] ABSTRACT

The present invention is directed to a process of forming a photographic element capable of forming a reversal image including a support and two silver halide emulsion layers primarily responsive to a different portion of the visible spectrum upon imagewise exposure of the photographic element. The emulsion layers are positioned to permit iodide ion migration therebetween upon development. Each emulsion layer contains silver halide grains capable of forming a latent image upon imagewise exposure and a hydrophillic colloid suspending the grains. One of the emulsion layers is comprised of silver haloiodide grains. One other of the silver halide emulsion layers additionally contains suspended in the hydrophilic colloid and interspersed with the latent image forming silver halide grains surface fogged silver halide grains which are spontaneously developable independently of imagewise exposure of the photographic element as though exposed to imaging radiation of maximum intensity. This invention also relates to obtaining a favorable interimage effect by reversal processing the photographic element with a silver halide solvent incorporated in the black-and-white developer solution.

19 Claims, 8 Drawing Figures

FIG. 1
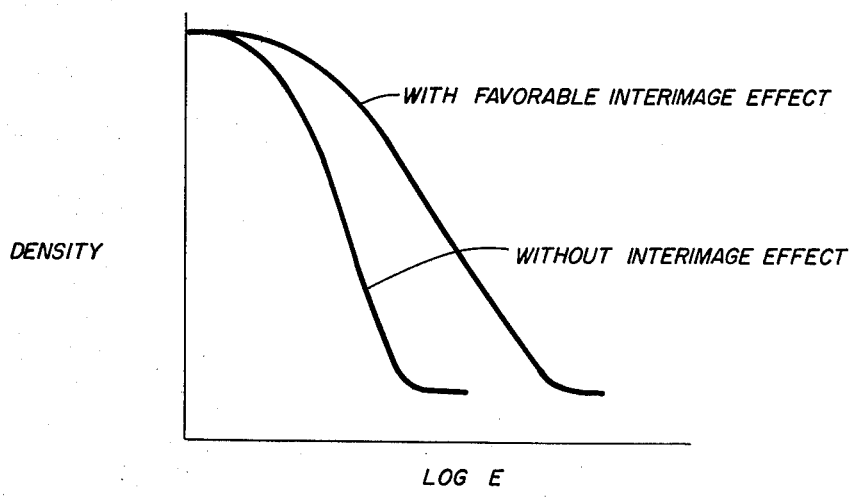
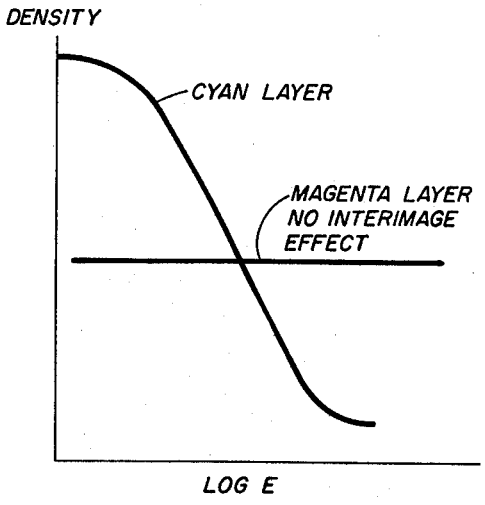
FIG. 2
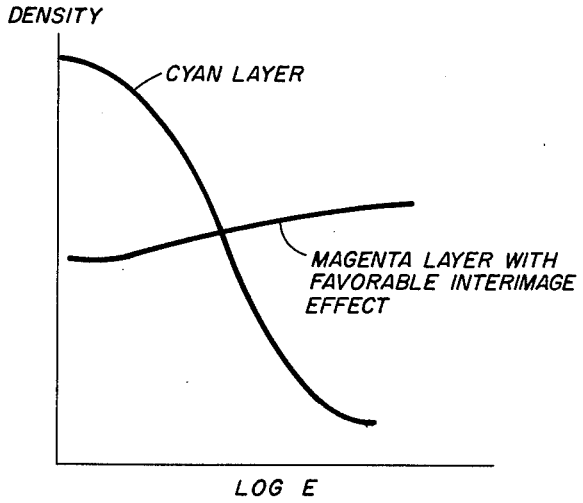
FIG. 3

INTERIMAGE EFFECTS WITH SPONTANEOUSLY DEVELOPABLE SILVER HALIDE

The present invention relates to forming improved photographic elements adapted to produce reversal images and to a reversal process. More particularly the present invention is directed to forming photographic elements adapted to produce color reversal images exhibiting an enhanced interimage effect and to a color reversal process therefor.

Conventional color reversal photographic elements are typically comprised of a photographic support having coated thereon a silver halide emulsion sensitized to red light within which a cyan dye image can be produced. Overlying the red sensitized silver halide emulsion layer is a silver halide emulsion sensitized to green light within which a magenta dye image can be produced. Overlying the green sensitized silver halide emulsion layer is a silver halide emulsion lyaer sensitive to blue light within which a yellow dye image can be produced. Since the silver halide emulsion layers sensitized to red and to green light have a native sensitivity to blue light as well and since it is desired to have only the yellow dye image record blue light received upon exposure, it is conventional practice to interpose a yellow filter layer, such as a yellow-dye or Carey Lea silver layer, between the blue-sensitive, yellow dye image layer and the green sensitized layer. In some elements one or more of the variously sensitized silver halide emulsions are formed as two or more separate layers of unequal speed. It is also conventional practice to interpose a gelatin interlayer between the red sensitized and the green sensitized silver halide emulsion layers to insure their separation in coating.

In use, conventional color reversal photographic elements are first imagewise exposed to a multicolor subject and then processed in a black-and-white photographic developer. Where the color reversal photographic element contains color-forming couplers, black-and-white development is followed by fogging chemically or through simultaneous exposure of all the residual silver halide in each of the layers. Color development is concurrently or thereafter undertaken and silver produced by both exposures and developments is removed from the photographic elements, so that a multicolor positive dye image is produced. Where the photographic element does not initially contain color-forming couplers, instead of simultaneous exposure of all layers, each layer can be separately rendered developable by monochromatic exposure and then color developed with the appropriate color-forming coupler for the layer being developed included in the color developer for that layer.

In the course of forming color reversal images of multicolor subjects in photographic elements it has been observed that the dye image in an individual layer of an element does not always correspond to that which would be predicted from monochromatic exposure of that same layer. The discrepancies that occur between dye images produced by monochromatic exposures and those produced by polychromatic exposures are referred to as "interimage effects". Interimage effects are usually favorable, but can be detrimental in some instances. Interimage effects have been characterized in terms of parameters such as contrast, speed, sharpness and color contamination.

One quantitative approach to measuring interimage effects is to compare the H and D curves of the dye images produced by polychromatic and monochromatic (used here to mean blue, green or red) exposures of two identical color reversal photographic film samples. In a color reversal photograph where favorable interimage effects are in evidence, the H and D curves progressively diverge from a common or near comon shoulder with the density of the curve produced by monochromatic exposure declining at a faster rate than the corresponding curve produced by polychromatic exposure. Thus, for a given level of exposure between the toe and shoulder of the monochromatic H and D curve a denser color image is produced by polychromatic exposure as a result of favorable interimage effects.

This is graphically illustrated in FIG. 1 in which the H and D curve produced by a layer of a reversal photographic element given a monochromatic exposure is compared to the H and D curve produced when the photographic element is given a polychromatic exposure. It can be seen that a denser image is obtained with a favorable interimage effect than without for a given exposure between the toe and shoulder of either curve.

A simpler approach to obtaining a quantitative evaluation of interimage effects is to expose uniformly a color reversal film sample to light within the third of the spectrum which the emulsion layer or layers being examined for interimage effects are expected to record and to expose the other emulsion layers through step tablets to light within the two remaining thirds of the spectrum. For example, if it is intended to observe interimage effects in the green sensitized layer of the photographic element, an overall uniform green light exposure falling within the mid-portion of the characteristic curve is given to the green sensitized layer and a stepped exposure by blue and red light is given to the blue-sensitive and/or red sensitized layers respectively. Without interimage effects the uniform green exposure will produce a magenta dye image of uniform density independent of the levels of exposure of the other layers to red and blue light. On the other hand, where favorable interimage effects are in evidence the magenta dye density will increase in proportion to the exposure given in the blue and red sensitized layers. A common approach to observing interimage effects by this technique is to expose the film within only two of the blue, green and red thirds of the visible spectrum, one uniformly and one through a step tablet. In this way the contribution to the interimage effects observed in a layer or layers responsive to one third of the spectrum can be related to stepped exposures of each of the two remaining thirds. To determine the relationship of the interimage effect to the level of exposure of the green sensitized layer, the above procedure can be repeated using different uniform green light exposures. Thus, interimage effects can be related both to the level of exposure of the layer in which they occur and to the level of exposure of other imaging layers of the photographic element.

The above procedure for determining interimage effects is graphically illustrated in FIGS. 2 and 3. In FIG. 2 the H and D curve of a cyan layer of a color reversal photographic element is shown where the layer has been exposed through a step tablet. The densities produced in the magenta layer of the photographic element which was concurrently given a uniform exposure are shown by the horizontal curve. Note that the density of the magenta layer is being plotted as a function of the log exposure of the cyan layer. In this instance the density of the magenta layer is not affected by varying exposure levels in the cyan layer and no interimage effects are in evidence. In FIG. 3 the procedure described above is repeated, but with a color reversal photographic element exhibiting a favorable interimage effect in the magenta layer. In this instance it can be seen that the density of magenta layer increases as a function of the exposure given the cyan layer, thereby indicating a favorable interimage effect.

A common favorable interimage effect observed in forming color images by reversal processing of conventional color reversal photographic elements occurs where at least one of the imaging layers contains a silver haloiodide emulsion and black-and-white development is undertaken in the presence of silver halide solvent, such as an alkali metal or ammonium thiocyanate or a thioether. A mechanism for obtaining the desirable interimage effect is as follows: In the black-and-white development step all of the exposed silver halide in a layer in which a favorable interimage effect is to be produced, hereinafter designated an affected layer, is chemically developed to silver. In the later stages of chemical development, or subsequent to chemical development, physical development of unexposed silver halide grains onto the chemically developed nuclei occurs. However, if an adjacent layer, hereinafter designated a causer layer, contains a haloiodide emulsion, physical development of the unexposed silver halide grains in the affected layer is repressed as a function of iodide ion diffusing from the developing areas of the causer layer. By repressing silver halide development during black-and-white development more silver halide remains in the affected layer to be developed and to produce a dye image during color development. Therefore, if a uniform, overall exposure is given to the affected layer and a stepped exposure is given to one or more of the causer layers, the result is that following reversal processing the affected dye layer exhibits an increased dye density in direct relation to the imaging exposure of the causer layers.

While I have described interimage effects in terms of dye image densities, interimage effects can also be discussed in terms of silver densities produced by imagewise exposure and development. Although interimage effects are observable in the form of dye images, they are in fact a function of silver halide emulsion exposure and development rather than the image dyes employed. It is accordingly apparent that interimage effects can occur even in black-and-white photographic elements having two or more silver halide emulsion layers of diiffering spectral sensitivity, although as a practical matter interimage effects are normally of interest only in reference to multicolor dye image producing photographic elements.

Interimage effects have been discussed in the literature, such as, for example, by Hanson and Horton, *Journal of the Optical Society of America,* Vol. 42, No. 9, pp. 663–669. Beavers U.S. Pat. No. 3,536,486, issued Oct. 27, 1970, teaches securing favorable "undercut" interimage effects by introducing a diffusible 4-thiazoline-2-thione into an exposed color reversal photographic element so that the 4-thiazoline-2-thione is present during development. Bent et al U.S. Pat. No. 3,658,525, issued Apr. 25, 1972, teaches enhancing intralayer and interlayer interimage effects in processing color reversal photographic elements by reversal color development with an aqueous alkaline color developing composition containing a 3-alkyl-N-alkyl-N-alkoxyalkyl-p-phenylenediamine or a 3-alkoxy-N-alkyl-N-alkoxyalkyl-p-phenylenediamine.

Yutzy et al U.S. Pat. No. 2,937,086, issued May 17, 1960, discloses a color reversal photographic element. Each of the color image-forming layers contains a gelatino-silver chlorobromide emulsion. The emulsion layers also contain fogged silver halide grains which serve as nucleating sites for dissolved silver salts during the step of color development. The emulsion layers additionally contain a nondiffusing reducing agent to prevent the migration of oxidized developer to adjacent layers during color development. Yutzy et al makes no mention of the use of silver haloiodide emulsions and does not mention interimage effects. Yutzy et al also does not employ an added silver halide solvent during black-and-white development.

Sease et al U.S. Pat. No. 2,319,369, issued May 18, 1943, teaches the use of interlayers in conventional color reversal photographic elements containing incorporated, colorforming couplers. Sease et al forms the interlayers of prefogged silver salts which are initially transparent, but which become light barrier layers as a result of silver development by the black-and-white developer. Sease et al does not specifically characterize the silver halide employed in the image-forming layers and makes no mention of interimage effects.

In Nicholas et al U.S. Pat. No. 3,737,317, issued June 5, 1973, it is noted that while silver haloiodide emulsion layers in color photographic elements are known to produce desirable interimage effects, processing with developers containing silver halide solvents causes iodide to enter solution, thereby inhibiting development and adversely affecting the sensitometric properties of the photographic element being processed. Nicholas et al points out that iodide-free Lippmann emulsions have been used as overcoats to inhibit release of iodided to the developer solution. Nicholas et al notes, however, that these Lippmann emulsions in turn produce disadvantages by silver plating out on transport rollers during processing. To obviate this, Nicholas et al teaches the coating of the Lippmann emulsion layer with a silver precipitating agent, such as metal sulfides, selenides, polysulfides and polyselenides, thiourea; heavy metals and heavy metal salts; fogged silver halide and Carey Lea silver.

Barr et al U.S. Pat. No. 3,227,551, issued Jan. 4, 1966, discloses a color image transfer photographic element which is capable of forming a positive color image using a negative working silver halide emulsion. To accomplish this the photographic element is divided into color forming units each containing a silver halide emulsion intended to respond to one triad of the visible spectrum upon exposure and a development inhibitor releasing (DIR) coupler. In an adjacent layer or in the same layer, where the light-sensitive silver halide emulsion is confined to a packet, a separate fogged silver halide emulsion is provided containing a dye producing coupler. On exposure and development the light-sensitive silver halide emulsion reacts with the DIR coupler to release mercaptan. The mercaptan migrates to the fogged silver halide and inhibits it from developing. Thus the fogged silver halide develops only in unexposed areas to form dye which can then be transferred. Because of the presence of the DIR coupler it would be disadvantageous to disperse the fogged silver halide grains in the imaging emulsion.

Luckey et al U.S. Pat. No. 2,996,382, issued Aug. 15, 1961, teaches the formation of negative image-forming photographic elements of enhanced speed by incorporating in an emulsion layer a combination of silver halide grains capable of forming a surface latent image upon exposure and silver halide grains containing internal fog centers, referred to as fogged internal image silver halide grains. Upon development after exposure the surface latent image bearing silver halide grains develop to liberate reaction products, specifically iodide, which cracks the internal latent image silver halide grains to reveal internal fog sites. In this way the negative silver image formed by surface latent image silver halide grain development is increased in density by the corresponding development of the internal latent image silver halide grains in the areas of exposure. It is to be noted that Luckey et al is using iodide ions to increase silver development rather than to repress physical development, as occurs in obtaining a favorable interimage effect.

Meeussen et al U.S. Pat. No. 2,672,800, issued Mar. 30, 1954, discloses the formation of reversal color images through the use of an image transfer photographic element having integral receiver layers. A triad of emulsion layers responsible to the blue, green and red portions of the spectrum, respectively, are each paired with a receiver layer containing development nuclei. Barrier layers are provided to functionally isolate each emulsion layer-receiver-layer pair. Following imagewise exposure black-and-white development is undertaken using a black-and-white developer solution that is free of silver halide solvent. Thus, no silver halide is free to migrate from an emulsion to a receiver layer during black-and-white development. Following black-and-white development, color development is undertaken using a developer solution containing a silver halide solvent. The silver halide that remains in the photographic element after initial, black-and-white development is solubilized and migrates to the paired receiver layer. Physical development occurs by reason of the physical development nuclei provided and dye is concurrently produced. Thus, a reversal dye image is formed in the receiver layers. It is to be noted that the barrier layers are intended to prevent interaction between adjacent emulsion layers.

Gevaert French Patent of Addition No. 53,513 teaches the modification of a color reversal photographic element similar to that disclosed by Meeussen et al, described above. Gevaert teaches that instead of having separate radiation-sensitive emulsion layers and receiver layers, it is possible to coat and dry one of the layers. This layer can then be comminuted and added to the coating composition for the remaining layer. In this way the receiver layer is broken up and distributed within the emulsion layer with which it is paired or vice versa. In another variation it is taught to add colloidal silver directly to an emulsion layer for the purpose of causing the layer to act as both a receiver and a radiation-sensitive layer. Development is undertaken in each instance as described above with reference to Meeussen et al.

Graham U.S. Ser. No. 502,573, filed Sept. 3, 1974, teaches the use of a colloidal silver layer between the cyan and magenta layers of a color reversal photographic element to obtain a favorable interimage effect. Graham makes no mention of using fogged silver halide grains to obtain favorable interimage effects and does not teach or suggest incorporating colloidal silver directly within the dye image-forming silver halide emulsion layers.

It is recognized in the art that photographic elements upon extended storage can develop a propensity toward elevated levels of fog. Antifoggants incoporated either in the photographic element itself or in a processing medium are commonly used to control these incipient fog levels. A similar propensity toward fog can be produced where a photographic element is over-finished—for example, heated during chemical sensitization beyond the point which produces the highest attainable photographic speed. Although photographic elements exhibiting such a propensity toward fog are frequently loosely referred to as "fogged" or "spontaneously developable", it must be borne in mind that even unexposed, unfogged silver halide grains are spontaneously developable if left in a photographic developer for a sufficient period of time. Photographic elements which are processed after extended storage in the absence of an antifoggant as well as over-finished photographic elements differ from unfogged, unexposed photographic elements in their fogging characteristics only in that somewhat reduced development times are required to produce a given minimum density. These photographic elements when placed in a developer do not rapidly produce high minimum densities, but rather the minimum densities increase gradually as a function of time. This behavior is in direct contrast to the response of silver halide grains which have received a maximum light exposure or which have been chemically fogged to at least the same extent through the use of chemical fogging or nucleating agents. The post-induction development response of both maximum exposed and nucleated silver halide grains is very rapid, if not immediate. A very high percentage of the maximum density attainable from these grains is produced at development times which may not even begin to reveal incipient elevated minimum density levels in overfinished or over-age photographic elements.

I have discovered quite unexpectedly a novel approach for obtaining favorable interimage effects in the course of forming a reversal photographic image. My invention is generally applicable to photographic elements comprising a support and, as coatings on the support, two silver halide emulsion layer units primarily responsive to a different portion of the visible spectrum upon imagewise exposure of the photographic element and positioned to permit iodide ion migration therebetween upon development. Each emulsion layer unit contains silver halide grains capable of forming a latent image upon imagewise exposure and a hydrophilic colloid suspending the grains. One of the emulsion layer units is comprised of silver haloiodide latent image-forming grains, and one other of the emulsion layer units additionally contains suspended in the hydrophilic colloid and interspersed with the latent image-forming silver halide grains, surface fogged silver halide grains which are spontaneously developable independent of imagewise exposure of the photographic element as though exposed to imaging radiation of maximum intensity.

In another aspect my discovery is directed to a process of forming color reversal images wherein a photographic element as described above is developed in the presence of a silver halide solvent. Thereafter the residual silver halide remaining in the photographic element is rendered developable, and the residual silver halide is developed in the presence of a color developing agent and a photographic coupler to produce a positive dye image exhibiting in at least the fogged silver halide grain containing emulsion layer a favorable interimage effect.

My invention can be better appreciated by reference to the following detailed description considered in conjunction with the drawings, in which FIGS. 1 through 3 are schematic plots of density versus the log of exposure and are intended to show qualitatively typical differences in curve configurations as a function of the presence or absence of favorable interimage effects.

Figure 4:
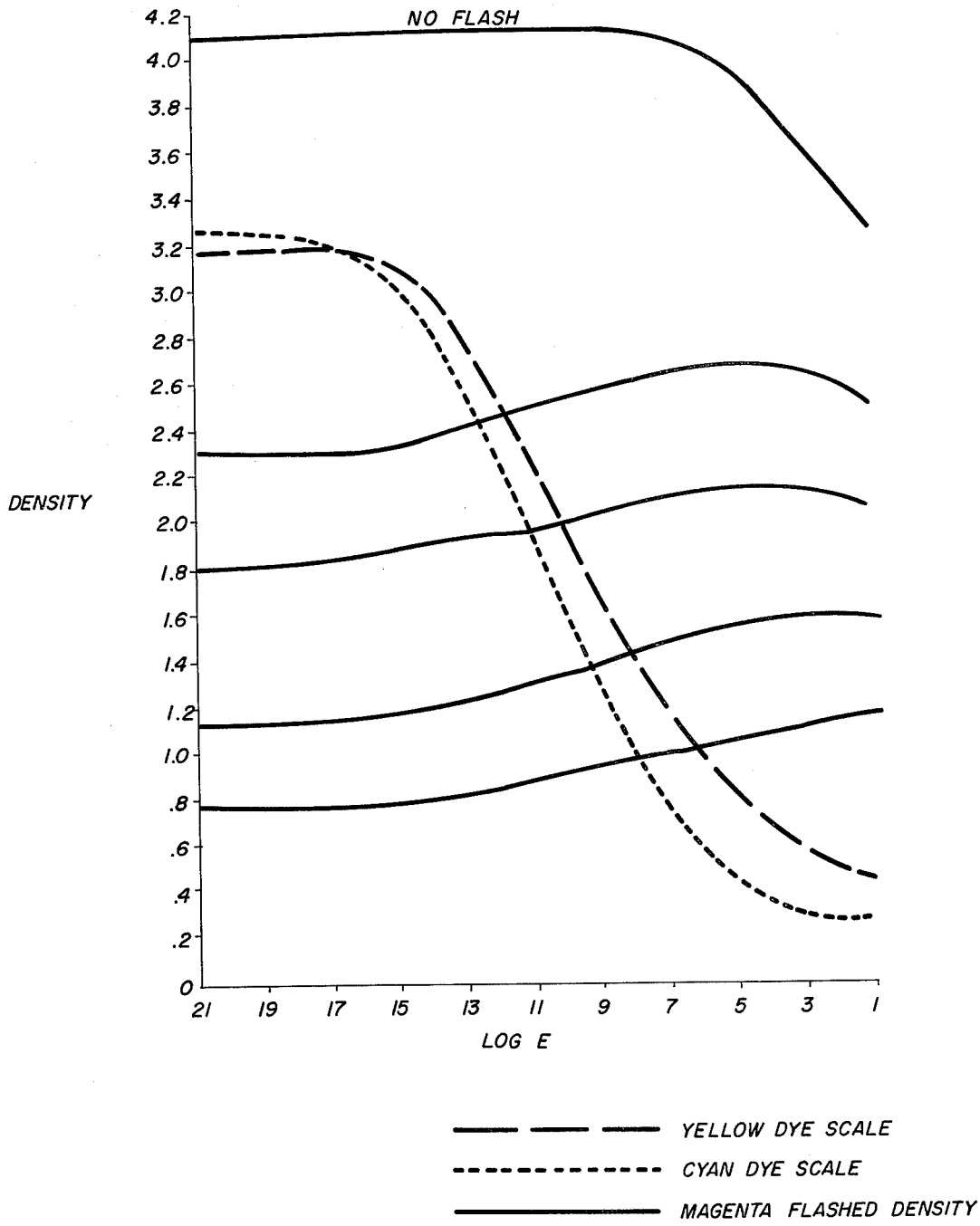
FIGS. 4 through 6 are sensitometric curves plotting density versus the log of exposure for the photographic elements of the Examples below.

The photographic elements formed according to my invention include at least one affected layer — that is, one silver halide emulsion layer in which a favorable interimage effect can be obtained — and at least one causer layer, which is an iodide ion generating layer, typically a silver haloiodide emulsion layer. The affected layer can take the form of any conventional silver halide layer employed as a dye image-forming layer in a color reversal photographic element. The affected layer is comprised of silver halide grains capable of forming a latent image upon imagewise exposure and a hydrophilic colloid. The silver halide can be any conventional photographic silver halide, such as silver chloride, silver bromide, silver bromoiodide, silver chlorobromide, silver chloroiodide, silver chlorobromoiodide and mixtures thereof. The silver halide grains which form latent images upon exposure are, of course, negative working, since development of the latent image sites formed on exposure produce a negative of the exposure image.

The silver halide grains of the affected layer are suspended in a hydrophilic collid photographic vehicle. Suitable hydrophilic colloid vehicle materials which can be used alone and in combination include both naturally occurring substances such as proteins, for example, gelatin, gelatin derivatives, cellulose derivatives, polysaccharides such as dextran, gum arabic and the like; and synthetic polymeric substances such as water soluble polyvinyl compounds like poly(vinylpyrrolidone), acrylamide polymers and the like.

Other synthetic polymeric vehicle compounds that can be used in combination with the hydrophilic colloid vehicle materials, include compounds such as dispersed vinyl compounds such as in latex form and particularly those which increase the dimensional stability of the photographic materials. Typical synthetic polymers include those described in Nottorf U.S. Pat. No. 3,142,568 issued July 28, 1964; White U.S. Pat. No. 3,193,386 issued July 6, 1965; Houck et al U.S. Pat. No. 3,062,674 issued Nov. 6, 1962; Houck et al U.S. Pat. No. 3,220,844 issued Nov. 30, 1965; Ream et al U.S. Pat. No. 3,287,289 issued Nov. 22, 1966; and Dykstra U.S. Pat. No. 3,411,911 issued Nov. 19, 1968. Other vehicle materials include those water-insoluble polymers of alkyl acrylates and methacrylates, acrylic acid, sulfoalkyl acrylates or methacrylates, those which have crosslinking sites which facilitate hardening or curing as described in Smith U.S. Pat. No. 3,488,708 issued Jan. 6, 1970, and those having recurring sulfobetaine units as described in Dykstra Canadian Pat. No. 774,054.

In addition, to latent image-forming silver halide grains and a hydrophilic colloid suspending these grains each affected layer additionally contains, dispersed among the imaging silver halide grains within the hydrophilic colloid, surface fogged silver halide grains which are spontaneously developable independently of imagewise exposure of the photographic element as though they had been exposed to imaging radiation of maximum intensity. The surface fogged grains can be formed prior to blending and coating by uniformly light exposing, introduction of reducing agents or chemically fogging with a conventional nucleating agent or by other conventional means. By surface fogging in this manner silver halide grains which are initially capable of forming a surface latent image the ability of these grains to form a latent image upon imagewise exposure of the photographic element is for practical purposes effectively destroyed. These surface fogged silver halide grains are spontaneously developable whether or not they have previously been imagewise exposed and are to be distinguished from surface fogged internal image silver halide grains which develop only if not exposed and internally fogged silver halide grains which do not develop in a surface developer. The surface fogged silver halide grains are to be further distinguished from over-age or over-finished silver halide grains which merely show a propensity toward fogging with increasing periods of development. The surface fogged silver halide grains are spontaneously developable to such an extent that they are indistinguishable in their development rates from the latent image forming silver halide grains which have received maximum light during imagewise exposure. In other words, the surface fogged silver halide grains respond on development as though they had received an actinic exposure of the maximum intensity the photographic element could reasonably be expected to receive. Or, stated in terms of a characteristic curve, if the surface fogged silver halide grains comprised the entirety of the silver halide grains in the emulsion layer in which they are incorporated, they should produce a density on development falling at or near the shoulder of the characteristic curve for the emulsion layer, and this density should be substantially independent of imagewise exposure.

The surface fogged silver halide grains can be of any conventional photographic size distribution or crystalline form. In a preferred form the surface fogged silver halide grains have a mean grain diameter which is no greater than that of the latent image-forming silver halide grains with which they are associated. Generally it is preferred to employ relatively fine surface fogged silver halide grains, since finer grains provide more nucleating sites for physical development with smaller amounts of silver. I prefer to employ surface fogged silver halide grains in the receiver layer having a mean diameter of less than 0.4 micron. It is further preferred to employ surface fogged silver halide grains which are of substantially uniform grain size—that is, differing in mean diameter by less than 50 percent. In many applications suitable fogged silver halide grains can be obtained merely by fogging as described above the surface latent image-forming silver halide grains contained within a portion of the silver halide emulsion which is to be used for imaging. The fogged portion of the emulsion is then blended with the remaining unfogged portion of the emulsion to achieve the desired proportion of fogged silver halide grains.

While the effectiveness of the surface fogged silver halide grains in the affected layer varies with the size of the silver halide grains chosen, generally favorable interimage effects can be recognized when as little as 0.05 percent of the surface fogged silver halide grains, based on the total weight of silver halide in the affected layer, is present. As the concentration of the surface fogged silver halide grains is increased the favorable interimage effect is enhanced until a level is reached where additional surface fogged silver halide grains do not produce a corresponding enhancement of the interimage effect. I contemplate the inclusion of from 0.05 to 50 percent by weight of surface fogged silver halide grains based on the total weight of silver halide in the affected layer, and for most applications from 0.1 to 25 percent surface fogged silver halide grains are preferred in the affected layer. From 0.5 to 10 percent surface fogged silver halide grains in the affected layer generally provide optimum enhancement of the interimage effect while efficiently employing the surface fogged silver halide grains.

In addition to at least one affected layer in which a favorable interimage effect is to be produced, the photographic elements formed according to my invention additionally include at least one causer layer. The causer layer can take the form of any conventional imaging layer employed in color reversal photographic elements which is chosen to be responsive to a different triad of the visible spectrum than the affected layer upon imagewise exposure of the photographic element and which contains silver haloiodide grains for imaging which are capable of forming a latent image upon exposure. The silver haloiodide grains are suspended in a conventional photographic vehicle material such as the hydrophilic colloids described above for inclusion in the affected layer. The term "silver haloiodide" is employed in its art recognized usage, as is illustrated in U.S. Pat. Nos. 3,536,486 and 3,737,317, cited above. That is, as employed herein, the term "silver haloiodide" refers to silver halide grains, each of which contain a mixture of at least one other photographically useful halide and iodide. Silver haloiodides include silver chloroiodide, silver bromoiodide and silver chlorobromoiodide. Advantageously, the silver haloiodide contains from 1 to 10 mole percent and, preferably, from 2 to 8 mole percent iodide.

To be effective in providing a favorable interimage effect the causer and affected layers must be positioned within the photographic element to permit iodide migration therebetween upon development. In a simple form the causer and affected layers can be coated in contiguous relationship. To insure that the causer and affected layers remain distinct it is desirable in many application to incorporate a conventional hydrophilic colloid interlayer between the adjacent causer and receiver layers. In still another instance the causer and affected layers can be separated by a filter layer, such as the yellow filter layer for blue light interposed between the blue-sensitive and green sensitized layers. In some instances a significant favorable interimage effect can be obtained even though the causer and affected layers are separated by another imaging layer. Thus, the causer and affected layers can be separated by one or a combination of layers, provided these layers are chosen to permit iodide ion migration. Typically the layer or layers separating the causer and affected layers are hydrophilic colloid layers where the hydrophilic colloid is of a type described above as useful as an emulsion vehicle. In a specifically preferred form the causer and affected layers are in direct contact or separated by no more than a conventional gelatin interlayer or yellow filter layer.

Although not required for the practice of my invention, it is preferred to incorporate a reducing agent within the interlayers or imaging layers. This can be accomplished by following the teachings of Yutzy et al U.S. Pat. No. 2,937,086, cited above, which teaches locating a reducing agent in the imaging layers or Weissberger et al U.S. Pat. No. 2,336.327, issued Dec. 7, 1943, which teaches locating a reducing agent in the interlayers. The reducing agent is useful in intercepting oxidized developer which would otherwise migrate between dye image-forming layers. Preferred reducing agents are aminophenol and dihydroxybenzenes, especially dihydroxybenzenes in which there is at least one (preferably two) alkyl substituents having a carbon chain of at least five carbon atoms, typically from 5 to 15 carbon atoms. Exemplary useful aminophenols and dihydroxybenzenes are the following:

(1) 2,5-dimethyl-4-γ-phenylpropylaminophenol,
(2) amyl hydroquinone,
(3) lauryl hydroquinone,
(4) heptyl hydroquinone,
(5) diamylhydroquinone,
(6) dioctylhydroquinone,
(7) 2,5-dihydroxydiphenyl, and
(8) 2,5-dihydroxy-4′-amyldiphenyl.

The reducing agent can be present in any desired concentration effective to inhibit staining, typically from 20 to 3000 mg/m$^2$, most preferably from 30 to 1500 mg/m$^2$.

In a preferred application of my invention a photographic element is provided comprised of three separate imaging units each responsive within a separate third of the visible spectrum. One of the imaging units contains a blue-sensitive silver halide emulsion. As employed herein, reference to blue-sensitive silver halide emulsions indicates that they are intended to record primarily light received on exposure of a wavelength below 500 nm. Blue-sensitive emulsions can be spectrally sensitized so that they absorb some light beyond 500 nm. The two remaining imaging units contain green and red spectrally sensitized silver halide emulsions, respectively. Green and red spectrally sensitized emulsions possess a native absorptivity for blue light, but are usually located to avoid exposure to blue light and therefore do not respond to blue light upon exposure of the photographic element. Green sensitized emulsions are those which absorb light upon exposure in a photographic element primarily within the range of from 500 to 600 nm. Such emulsions frequently absorb some light outside this range. Similarly red sensitized emulsions are those which absorb visible light primarily above 600 nm upon exposure in a photographic element. Red sensitized emulsions frequently absorb some light outside this range. Any of the blue, green and red emulsion layers can be affected layers and any of the remaining imaging layers can be causer layers. In a preferred form all of the blue, green and red emulsion layers can be both affected and causer layers. In many practical applications it is particularly desired that the green emulsion layer be an affected layer, since favorable interimage effects are most typically needed in this layer to produce a pleasing photographic image.

Except as noted above, the features of the photographic elements formed according to my invention can be of any convenient conventional form. In one preferred form the photographic elements formed according to my invention are color reversal photographic elements containing incorporated dye-forming couplers. In an illustrative form such a photographic element can be comprised of a plurality of layers arranged in the sequence recited below.

I. Photographic Support

Exemplary preferred photographic support include cellulose acetate and poly(ethylene terephthalate) film supports and photographic paper supports, especially paper support which is partially acetylated or coated with baryta and/or alpha-olefin polymer, particularly a polymer of an alpha-olefin containing 2 to 10 carbon atoms such as polyethylene, polypropylene, ethylenebutene copolymers and the like.

II. Subbing Layer

To facilitate coating on the photographic support it is preferred to provide a gelatin or other conventional subbing layer or combination of subbing layers.

III. Red Sensitized Silver Haloiodide Emulsion Unit

At least one layer comprised of a red sensitized silver haloiodide emulsion, as described above, is provided. At least one conventional cyan dye image-forming coupler is included, such as, for example, one of the cyan dye-forming couplers disclosed in the following U.S. Patents: Nos. 2,423,730; 2,706,684; 2,725,292; 2,772,161; 2,772,162; 2,801,171; 2,895,826; 2,908,573; 2,920,961; 2,976,146; 3,002,836; 3,034,892; 3,148,062; 3,214,437; 3,227,554; 3,253,924; 3,311,476; 3,419,390; 3,458,315 and 3,476,563.

IV. Interlayer

At least one hydrophilic colloid interlayer, preferably a gelatin interlayer which includes a reducing agent, such as aminophenol or an alkyl substituted hydroquinone, is provided. In one specific form the interlayer can additionally contain colloidal silver for the purpose of further enhancing the favorable interimage effect, as taught by Graham U.S. Ser. No. 502,573, cited above. In this instance the interlayer can take the form of a conventional Carey Lea silver yellow filter layer.

V. Green Sensitized Silver Haloiodide Emulsion Unit

At least one layer comprised of a green sensitized silver haloiodide emulsion, as described above, is provided. At least one conventional magenta dye image-forming coupler is included, such as for example, one of the magenta dye-forming couplers disclosed in the following U.S. Patents: Nos. 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,432,521; and 3,519,429.

VI. Yellow Filter Layer

A yellow filter layer is provided for the purpose of absorbing blue light. The yellow filter layer can take any convenient conventional form, such as a gelatino-yellow colloidal silver layer (i.e., a Carey Lea silver layer), a yellow dye containing gelatin layer, etc. In one preferred form the yellow filter layer is identical to the colloidal silver form of Interlayer IV, above, and contains a reducing agent, such as an amino phenol or an alkyl substituted hydroquinone.

VII. Blue-Sensitive Silver Haloiodide Emulsion Unit

At least one layer comprised of a blue-sensitive silver haloiodide emulsion is provided, as described above as useful in the Red Sensitized Silver Haloiodide Emulsion Unit III and the Green Sensitized Silver Haloiodide Emulsion Unit V, differing primariy only in lacking a green or red sensitizer, but preferably including a blue sensitizer. At least one conventional yellow dye image-forming coupler is included, such as, for example, one of the yellow dye-forming couplers disclosed in the following U.S. Patents: Nos. 2,875,057; 2,895,826; 2,908,573; 2,920,961; 3,148,062; 3,227,554; 3,253,924; 3,265,506; 3,277,155; 3,369,895; 3,384,657; 3,408,194; 3,415,652 and 3,447,928.

VIII. Overcoat Layer

At least one overcoating layer is provided. Such layers are typically transparent gelatin layers and contain known addenda for enhancing coating, handling and photographic properties.

In a specifically preferred form each of the above red sensitized, green sensitized and blue-sensitized haloiodide emulsion units are present in the form of two distinct layers. The layers preferably differ in photographic speed with the slower layer lying nearer the support. The faster layer overlies the slower layer and can be separated from the slower layer by a hydrophilic colloid interlayer. Either or both layers of each layer pair can be affected layers formed according to this invention. Where only one layer of each layer pair is an affected layer, it is preferred that the slower layer be the affected layer.

It is specifically preferred that the latent image forming silver halide grains of affected layers, such as each of the above red sensitized, green sensitized and blue-sensitive haloiodide emulsion units, be protected against fogging and against loss of sensitivity during keeping. Since the surface fogged silver halide grains in the affected layers can be fogged by exposure or chemical nucleation before blending with the latent image forming silver halide grains, the presence of an antifoggant and surfaced fogged silver halide grains in a single emulsion layer is not incompatible. Conventional antifoggants and stabilizers are preferably incorporated in the emulsion layers for this purpose. Exemplary useful antifoggants and stabilizers, each used alone, or in combination, include: (a) thiazolium salts described in Brooker et al U.S. Pat. No. 2,131,038 issued Sept. 27, 1938 an Allen et al U.S. Pat. No. 2,694,716 issued Nov. 16, 1954; (b) the azaindenes described in Piper U.S. Pat. No. 2,886,437 issued May 12, 1959 and Heimbach et al U.S. Pat. No. 2,444,605 issued July 6, 1948; (c) the mercury salts as described in Allen et al U.S. Pat. No. 2,728,663 issued Dec. 27, 1955; (d) the urazoles described in Anderson et al U.S. Pat. No. 3,287,135 issued Nov. 22, 1966; (e) the sulfocatechols described in Kennard et al U.S. Pat. No. 3,236,652 issued Feb. 22, 1966; (f) the oximes described in Carroll et al British Pat. No. 623,448 issued May 18, 1949; (g) nitron; (h) nitroindazoles; (i) the mercaptotetrazoles described in Kendall et al U.S. Pat. No. 2,403,927 issued July 16, 1946; Kennard et al U.S. Pat. No. 3,266,897 issued Aug. 16, 1966; and Luckey et al U.S. Pat. No. 3,397,987 issued Aug. 20, 1968; (j) the polyvalent metal salts described in Jones U.S. Pat. No. 2,839,405 issued June 17, 1958; (k) the thiuronium salts described in Herz et al U.S. Pat. No. 3,220,839 issued Nov. 30, 1965; and (l) the palladium, platinum and gold salts described in Trivelli et al U.S. Pat. No. 2,566,263 issued Aug. 28, 1951; and Yutzy et al U.S. Pat. No. 2,597,915 issued May 27, 1952.

An alternative preferred form of a color reversal photographic element according to my invention is identical to that disclosed above, except that the dye-forming couplers are omitted from the silver halide emulsion layers.

For a more detailed discussion of those conventional photographic element features not specifically included above, the various patents cited above relating to photographic elements having at least two silver halide emulsion layers which are differently spectrally sensitized and their processing are here included by reference as well as *Product Licensing Index,* Volume 92, December 1971, publication 9232, pages 107 through 110.

Forming a reversal color image according to my invention which exhibits a favorable interimage effect can be readily accomplished using photographic elements as described above containing surface fogged silver halide grains. Following imagewise exposure, the photographic elements are given a first development in a silver halide developer solution containing a silver halide solvent. The purpose of the silver halide solvent is to enhance the physical development of silver in areas of the affected layers corresponding to unexposed areas of the causer layers during black-and-white development. Conventional types and quantities of silver halide solvents known to enhance interimage effects favorably in silver haloiodide photographic elements can be generally employed. For example, I prefer to employ thioether or alkali metal or ammonium thiocyanate silver halide solvents in concentrations of from about 0.25 to 10 grams/liter of developer solution, optimally at concentrations of from 1 to 3 grams/liter of developer solution. Useful thioether silver halide solvents are disclosed in McBride U.S. Pat. No. 3,271,157, issued Sept. 6, 1966; useful thiocyanate silver halide solvents are disclosed in Nutz and Russell U.S. Pat. No. 2,222,264, issued Nov. 19, 1940, Lowe et al U.S. Pat. No. 2,448,534, issued Sept. 7, 1948, and Illingsworth U.S. Pat. No. 3,320,069, issued May 16, 1967, the disclosures of which are here incorporated by reference.

Typically the first developer solution is a black-and-white developer—that is, it is devoid of developing agents which when oxidized will react with photographic couplers to produce dyes. Where neither the developer solution nor the photographic element contains photographic couplers or similar dye formers, the first developer solution can include color developing agents as well as black-and-white developing agents. Black-and-white developing agents are generally more active developing agents than color developing agents and are therefore preferred in most applications. During the first development step all of the silver halide grains which were initially surface fogged or which were imagewise exposed are reduced to silver.

The next essential reversal processing step is to render the remaining silver halide grains developable. This can be done by any conventional technique, including, for example, the fogging techniques described above for producing the surface fogged silver halide grains. Typically either a uniform exposure of the photographic element or one or more nucleating agents are employed to render the remaining silver halide in the photographic element developable.

Once the remaining silver halide grains are developable, the photographic element is placed in a color developer solution. The color developer solution can be of any conventional type. The color developer solution is so termed, since it contains at least one color developing agent—that is, a developing agent, such as an aminophenol or p-phenylenediamine having a primary amine group and capable of entering into a redox reaction with silver halide and thereafter reacting with a photographic coupler to form a dye. The photographic coupler (or an equivalent dye image former) can be present in either the photographic element or the color developer solution.

In order to obtain photograpic dye images of higher quality generally desired for most commercial applications, a number of processing steps are typically performed in color reversal processing in addition to those described above. For example, the photographic element is typically placed in a stop bath (a dilute acid solution) after each development step. Additionally, the photographic element may be brought into contact with a hardener bath or a photographic hardener may be incorporated in one of the remaining processing solutions. Aqueous rinse baths are also employed between processing steps. Generally the developed silver is removed in a bleach bath following the second development step. Any residual silver halide not developed is typically removed using a fix bath. To improve dye stability and to prevent minimum density increase a stabilizer bath is also commonly employed at or near the conclusion of the processing. These processing steps and the compositions of the baths employed are well known in the photographic arts. Black-and-white developer solutions, hardener baths, stop baths, fix baths are disclosed in *Processing Chemicals and Formulas,* 6th Edition, Eastman Kodak Company (1963). A discussion and comparison of commercial reversal color processes useful in the practice of this invention appears at Chapter 13, Practical Color Processes, *Photochemistry in Black-and-White and Color Photography,* Eastman Kodak Company (1957). Exemplary of a preferred processing technique for color reversal photographic elements is that disclosed in *The British Journal of Photography Annual* (1973) pp. 208–210. In this process the first (black-and-white) developer contains, inter alia 1.3 g/l of sodium thiocyanate as a silver halide solvent.

My invention is further illustrated by the following examples

EXAMPLES

A color photographic element containing a plurality of selectively sensitized, photographic silver halide emulsions was prepared. The photographic element employed comprised a transparent film support having coated thereon in the order recited:

(1) a red sensitized double layer comprising:
  (a) a fine-grain, red sensitized gelatino-silver bromoiodide emulsion layer (42 mgAg/0.093m$^2$) containing a cyan-dye-forming phenolic coupler dispersed in a conventional coupler solvent;
  (b) a coarser-grain, faster red sensitized gelatino-silver bromoiodide emulsion layer (69 mgAg/0.093m$^2$) containing a cyan-dye-forming phenolic coupler dispersed in a conventional coupler solvent;
(2) a gelatin interlayer;
(3) a green sensitized double layer comprising:

(a) a fine-grain, green sensitized gelatino-silver bromoiodide emulsion layer (42 mgAg/0.093m$^2$) containing a magenta-dye-forming pyrazolone coupler dispersed in a conventional coupler solvent;

(b) a coarser-grain, faster green sensitized gelatino-silver bromoiodide emulsion layer (75 mgAg/0.093m$^2$) containing magenta-dye-forming pyrazolone coupler dispersed in a conventional coupler solvent;

(4) a yellow filter layer comprising Carey Lea silver dispersed in gelatin;

(5) a blue-sensitive double layer comprising:

(a) a fine-grain, blue-sensitive gelatino-silver bromoiodide emulsion layer (53 mgAg/0.093 m$^2$) containing a yellow-dye-forming, open chain ketomethylene coupler dispersed in a conventional coupler solvent;

(b) a coarser-grain, faster blue-sensitive gelatino-silver bromoiodide emulsion layer (83 mgAg/0.093m$^2$) containing a yellow-dye-forming, open chain ketomethylene coupler dispersed in a conventional coupler solvent; and (6) a gelatin overcoat layer.

The color photographic element described above was of conventional construction throughout and was formed to provide a basis for comparison. Each emulsion layer contained a conventional benzothiazolium salt antifoggant. This element is hereafter referred to as the Control. A second color photographic element was formed identical to the Control, except for the inclusion of fogged silver bromoiodide grains in the green sensitized, faster emulsion layer. This was achieved by chemically fogging the silver halide grains of a portion of the green sensitized, slower emulsion and blending the emulsions containing fogged and unfogged silver halide grains to obtain a coating density of 6 mg fogged silver per 0.093 square meters. A third color photographic element was similarly formed, except that the slower green sensitized emulsion layer was modified rather than the faster layer.

To evaluate the interimage effects produced, samples of each element were given a red and blue exposure through a graduated density test object having 21 equal density steps ranging from 0 density at Step 1 to a density of 3.0 at Step 21 and a uniform green flash, separate samples receiving differing intensities of the uniform green flash, including no green flash exposure. The exposed samples were then processed with a conventional color reversal process similar to the Ektachrome E4 process described in *The British Journal of Photography Annual,* cited above. The sensitometric results of the processed samples were recorded as sensitometric curves of the type illustrated in FIGS. 2 and 3, described above. The photographic elements exhibited an ASA photographic speed of approximately 50.

FIG. 4 illustrates the sensitometric curves obtained in exposing the Control. FIG. 4 shows that no interimage effect is being obtained in the absence of a flash exposure of the green sensitized layers. Where a uniform flash exposure of the green sensitized layers was made, a favorable interimage effect was observed, as indicated by the upward slope of the magenta dye curve with increasing exposure of the blue-sensitive and red sensitized layers.

Figure 5:
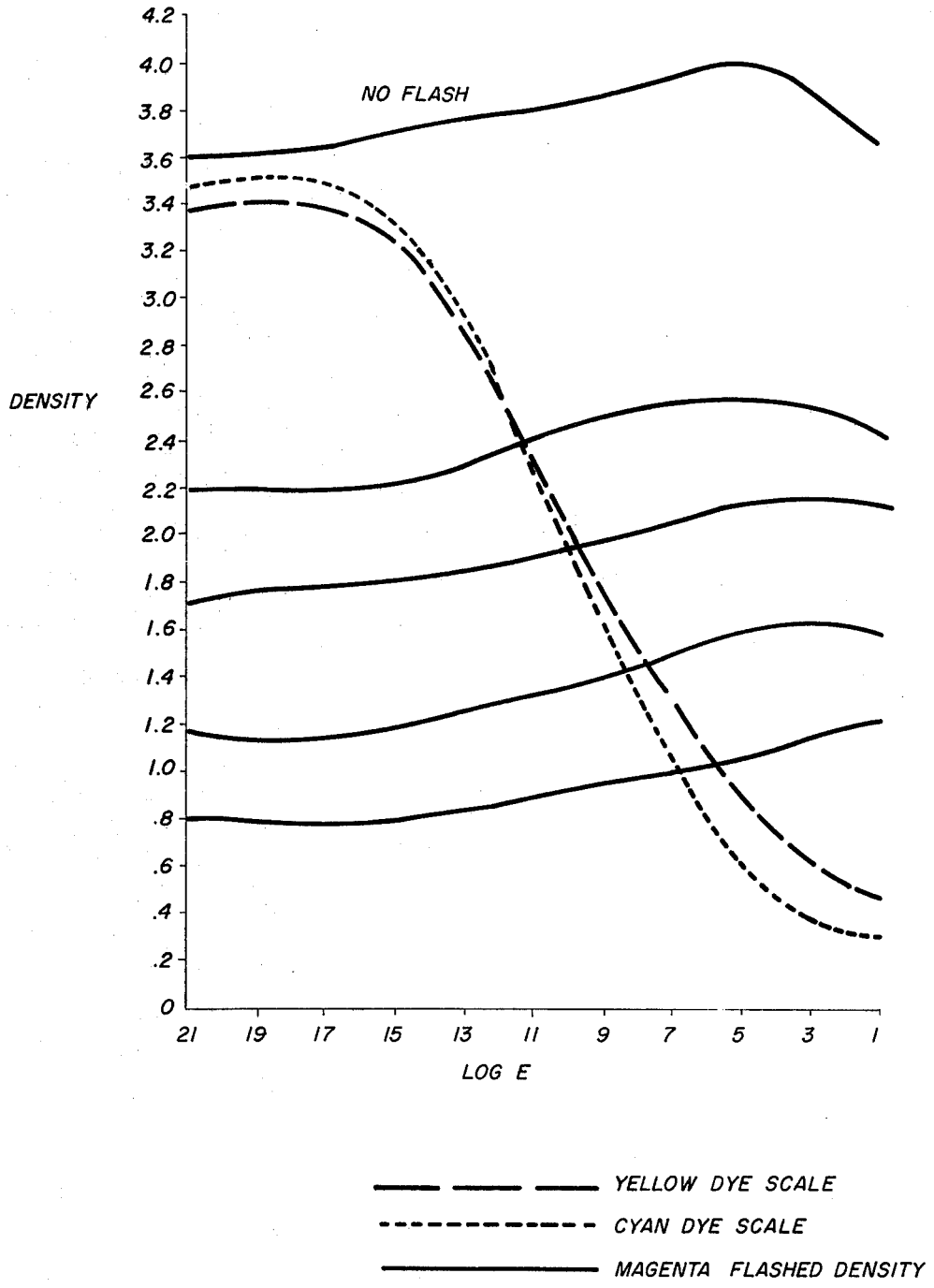

FIG. 5 illustrates the sensitometric curves obtained in exposing the photographic element containing fogged silver halide grains in the faster green sensitized layer. Although generally comparable favorable interimage effects are shown at higher levels of uniform flash exposure, it is apparent that more favorable interimage effects are obtainable according to my invention at lower levels of green sensitized layer exposure.

Figure 6:
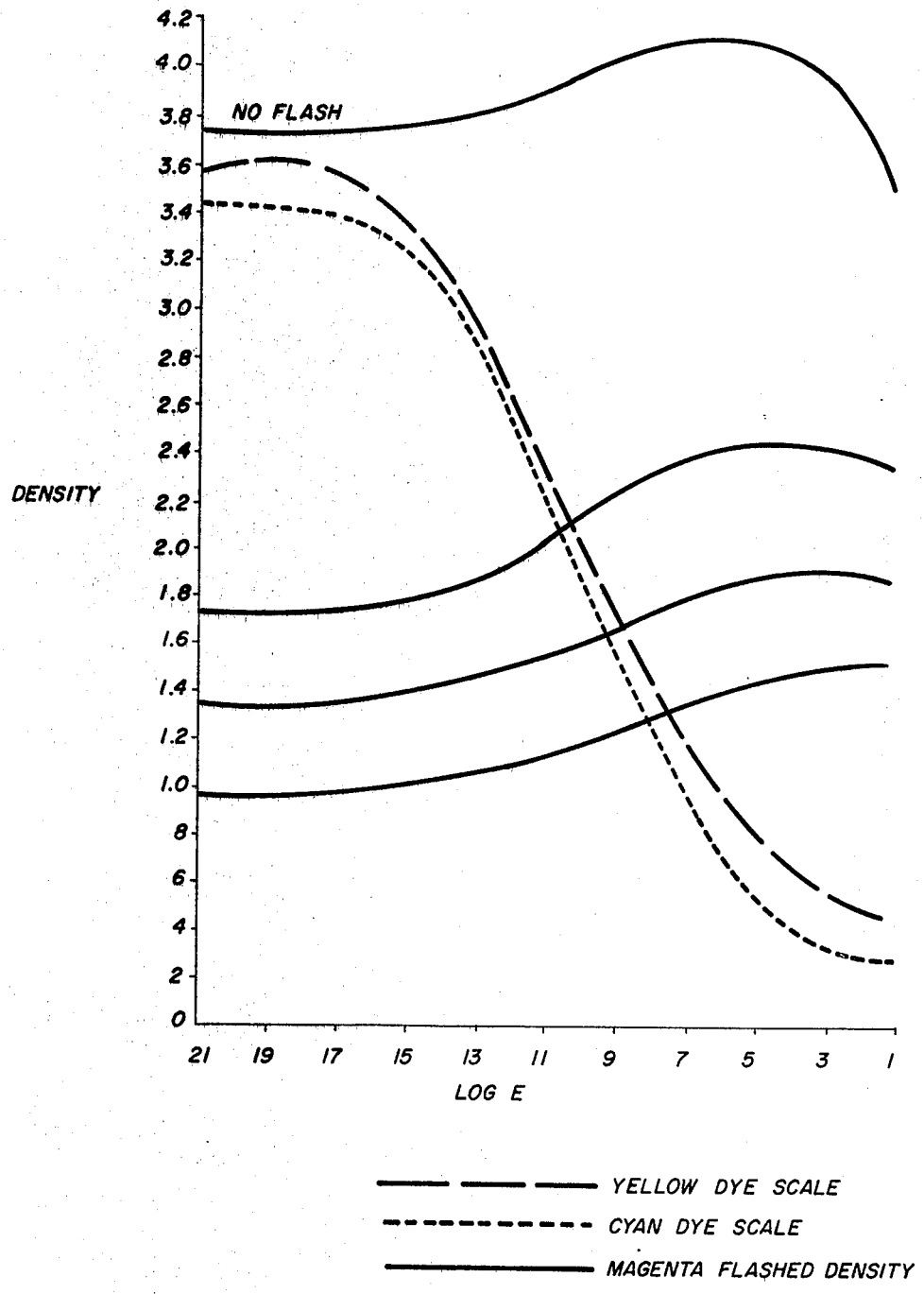
Figure 7:
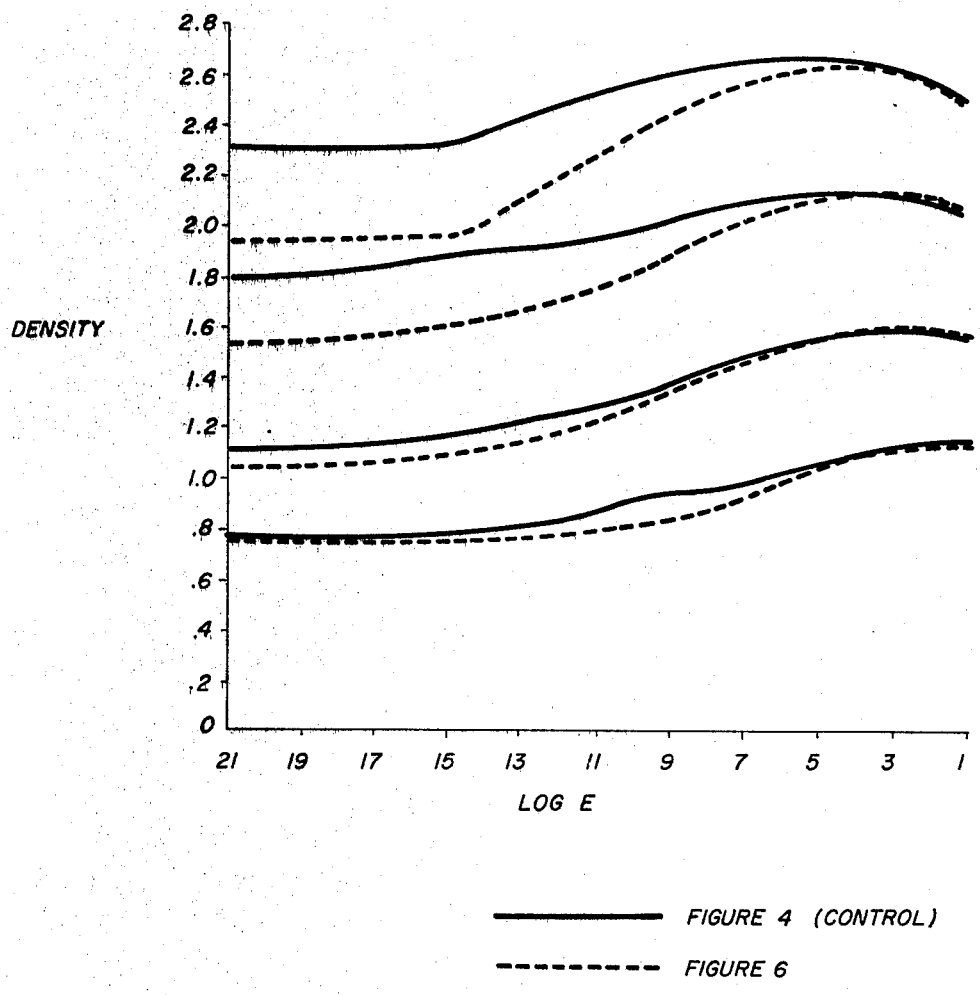
FIG. 7 is a superposition of the curves of FIGS. 4 and 6 produced through uniform exposures of the green sensitized layers.

FIG. 6 illustrates the sensitometric curves obtained in exposing the photographic element containing fogged silver halide grains in the slower green sensitized layer. It is apparent that a much more pronounced favorable interimage effect has been obtained at all levels of green sensitized layer exposure than in FIGS. 4 and 5. FIG. 7 directly compares the sensitometric curves obtained by uniform green exposure of the Control and the photographic element according to my invention including fogged silver halide grains in the slower green sensitized layer.

Figure 8:
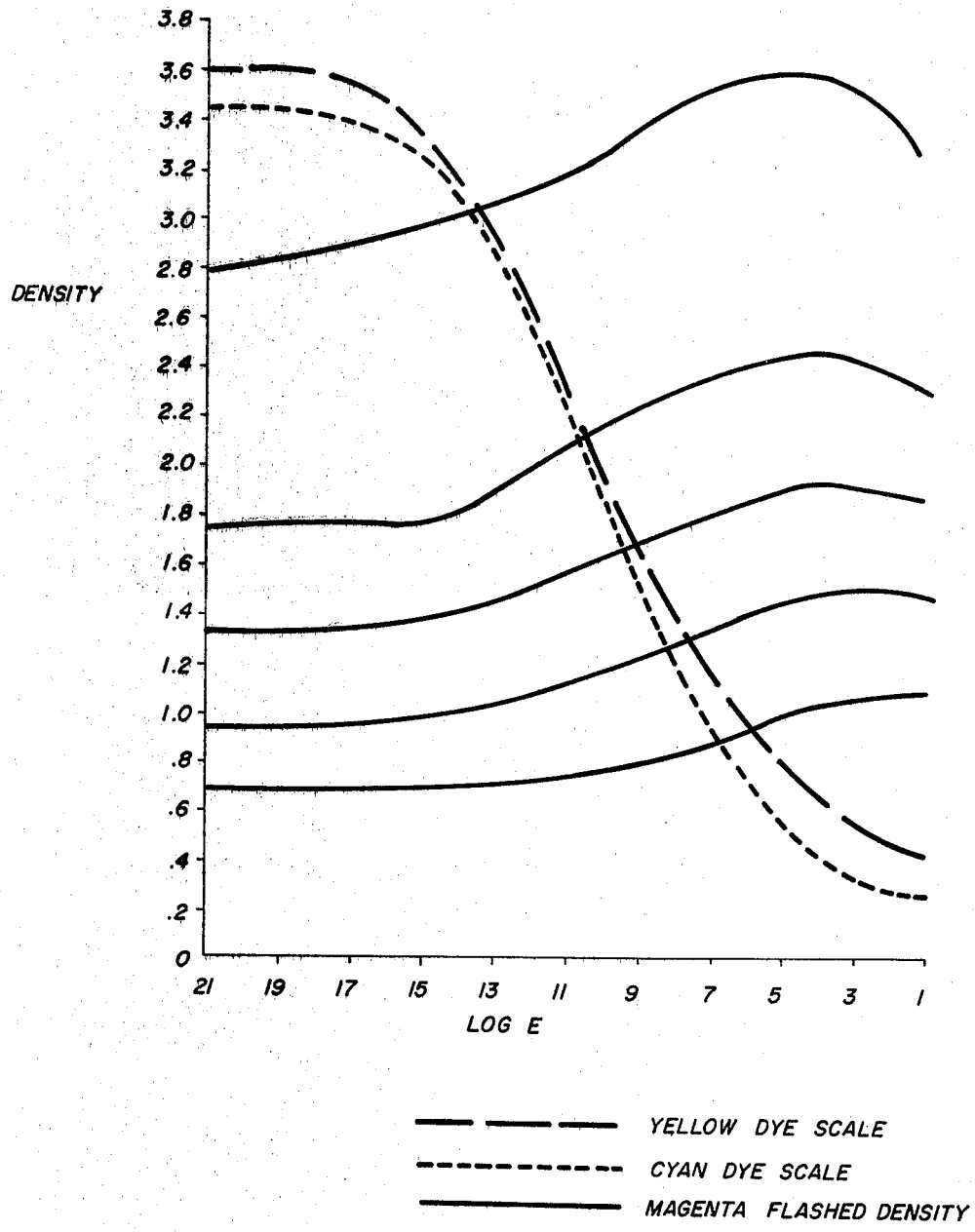
FIG. 8 is a calculated composite of the sensitometric curves of FIGS. 5 and 6.

It is recognized that the favorable interimage effects obtainable in the faster and slower green sensitized layers should be cumulative. Thus the incorporation of fogged silver halide grains in both of the green sensitized layers of the above-tested photographic elements would be expected to produce a favorable interimage effect which is greater than the individual favorable interimage effects observed. The cumulative favorable interimage effect that would be expected, based on calculated values taken from FIGS. 5 and 6, is shown in the composite sensitometric curves of FIG. 8.

In looking at the sensitometric curves of FIGS. 4 through 8 it is apparent that the presence of the fogged silver halide grains in the affected layers (in this instance the green sensitized layers) has decreased the maximum magenta dye density which can be produced in the portions of the photographic elements receiving low levels of blue and red exposure. In forming an attractive color reversal photographic element it will in most instances be desired to offset this reduction of maximum magenta dye density merely by increasing somewhat the amount of unfogged silver halide emulsion included in the green sensitized layers containing fogged silver halide grains. This would result in an upward displacement of the magenta dye curves shown in the figures to permit a complete realization of the favorable interimage effects which can be obtained through the practice of my invention. Such an adjustment in the amount of silver halide grains is, of course, well within the ordinary skill of the art.

As employed above the term "triads" as applied to the visible spectrum refers to the blue (400 to 500 nanometers), green (500 to 600 nanometers) and red (600 to 700 nanometers) segments of the visible spectrum while a single triad of the visible spectrum designates a single one of these segments.

The invention has been described with reference to particular preferred embodiments thereof but it will be understood that variations and modifications thereof can be effected within the spirit and scope of the invention.

I claim:

1. In a process of forming a photographic element capable of forming a reversal image comprising providing a support, and coating onto the support two silver halide emulsion layer units primarily responsive to a different portion of the visible spectrum upon imagewise exposure of said photographic element and positioned to permit iodide ion migration therebetween upon development, each of said emulsion layer units containing silver halide grains capable of forming a latent image upon imagewise exposure and a hydrophilic colloid suspending said grains, and one of said layer units being comprised of silver haloiodide latent image-forming grains, the improvement comprising in preparing one other of said layer units forming a blended silver halide emulsion by interspersing with said hydrophilic colloid suspended latent image-forming silver halide grains hydrophilic colloid suspended, silver halide grains which are surface fogged as though exposed to imaging radiation of maximum intensity to render them spontaneously developable independent of imagewise exposure of said photographic element.

2. A process of forming a photographic element capable of forming a reversal image according to claim 1 wherein at least said one other layer unit contains a photographic coupler.

3. A process of forming a photographic element capable of forming a reversal image according to claim 2 wherein said one other layer unit contains a magenta-dye-forming coupler.

4. A process of forming a photographic element capable of forming a reversal image according to claim 1 additionally including an antifoggant in said emulsion layer unit containing said surface fogged silver halide grains.

5. A process of forming a photographic element capable of forming a reversal image according to claim 1 wherein said one layer unit and said one other layer unit are adjacent silver halide emulsion layers.

6. A process of forming a photographic element capable of forming a reversal image according to claim 1 wherein said one other layer unit contains from 0.05 to 50 percent of said surface fogged silver halide grains, based on the total weight of silver halide present in said one other layer unit.

7. A process of forming a photographic element capable of forming a reversal image according to claim 6 wherein said one other layer unit contains from 0.1 to 25 percent of said surface fogged silver halide grains, based on the total weight of silver halide present in said one other layer unit.

8. A process of forming a photographic element capable of forming a reversal image according to claim 7 wherein said one other layer unit contains from 0.5 to 10 percent of said surface fogged silver halide grains, based on the total weight of silver halide present in said one other layer unit.

9. A process of forming a photographic element capable of forming a reversal image according to claim 1 wherein said silver halide emulsion layer units each contain silver haloiodide emulsion layers.

10. In a process of forming a photographic element capable of forming a color reversal image comprising providing a support, and coating onto the support three silver haloiodide hydrophilic colloid emulsion imaging layers units chosen and arranged to be each primarily responsive upon imagewise exposure of said photographic element to a different one of the blue, green and red thirds of the visible spectrum and to permit iodide migration therebetween upon development, each of said emulsion layer units containing silver halide grains capable of forming a latent image upon imagewise exposure and a hydrophilic colloid suspending said grains, the improvement comprising in preparing at least one of said emulsion layer units forming a blended silver halide emulsion by interspersing with hydrophilic colloid suspended latent image forming silver haloiodide grains hydrophilic colloid suspended, relatively fine silver halide grains which are of substantially uniform grain size and are surface fogged as though exposed to imaging radiation of maximum intensity to render them spontaneously developable independent of imagewise exposure of said photographic element.

11. A process of forming a photographic element according to claim 10 wherein said emulsion layer units responsive within the blue, green and red thirds of the visible spectrum contain yellow-dye-forming couplers, magenta-dye-forming couplers and cyan-dye-forming couplers, respectively.

12. A process of forming a photographic element according to claim 10 additionally including an antifoggant in said emulsion layer unit containing said surface fogged silver halide grains.

13. A process of forming a photographic element according to claim 10 wherein said surface fogged silver halide grains are no larger than the imaging silver halide grains with which they are blended.

14. A process of forming a photographic element according to claim 10 wherein said surface fogged silver halide grains are present in an concentration of from 0.1 to 25 percent, based on the total weight of silver halide present in said emulsion layer unit in which they are blended.

15. In a process of forming a photographic element capable of forming a color reversal photographic image comprising providing a photographic support, and coating onto the support, in the order recited, a slower red sensitized negative working gelatino-silver bromoiodide emulsion layer, a faster red sensitized negative working gelatino-silver bromoiodide emulsion layer, a gelatin interlayer, a slower green sensitized negative working gelatino-silver bromoiodide emulsion layer, a faster green sensitized negative working gelatino-silver bromoiodide emulsion layer, a gelatin interlayer including dispersed therein means to filter blue light, a slower blue sensitive negative working gelatino-silver bromoiodide emulsion layer, and a faster blue sensitive negative working gelatino-silver bromoiodide emulsion layer, the improvement comprising in preparing at least one of said emulsion layers blending therein an emulsion of gelatin and relatively fine silver halide grains which are of substantially uniform grain size and are surface fogged as though exposed to imaging radiation of maximum intensity and which are capable of providing physical development sites regardless of imaging exposure thereof, said surface fogged silver halide grains being present in an amount sufficient to provide a favorable interimage effect upon polychromatic imaging exposure of said photographic element.

16. A process of forming a photographic element according to claim 15 wherein said surface fogged silver halide grains are located in said slower green sensitized emulsion layer.

17. A process of forming a photographic element according to claim 16 wherein said surface fogged silver halide grains are located in said faster green sensitized emulsion layer.

18. A process of forming a photographic element according to claim 15 wherein said surface fogged silver halide grains are present in said slower green sensitized emulsion layer in a concentration of from 0.5 to 10 percent, based on the total weight of silver halide present in said slower green emulsion layer.

19. A process of forming a photographic element according to claim 15 wherein said slower green sensitized negative working gelatino-silver bromoiodide emulsion layer contains a magenta-dye-forming coupler and from 0.5 to 10 percent, based on the total weight of silver halide present in said layer, of relatively fine silver halide grains which are of substantially uniform grain size and are surface fogged as though exposed to imaging radiation of maximum intensity and capable of providing physical development sites independent of imaging exposure, said surface fogged silver halide grains being gelatin emulsified and surface fogged when blended with latent image-forming silver bromoiodide grains of said gelatino-silver bromoiodide emulsion.

* * * * *